US011760595B2

(12) United States Patent
Tanaka et al.

(10) Patent No.: US 11,760,595 B2
(45) Date of Patent: Sep. 19, 2023

(54) SHEET FEEDING DEVICE AND IMAGE FORMING APPARATUS

(71) Applicant: KYOCERA Document Solutions Inc., Osaka (JP)

(72) Inventors: Yuichiro Tanaka, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 296 days.

(21) Appl. No.: 17/347,671

(22) Filed: Jun. 15, 2021

(65) Prior Publication Data

US 2021/0395029 A1 Dec. 23, 2021

(30) Foreign Application Priority Data

Jun. 18, 2020 (JP) ..... 2020-105039

(51) Int. Cl.

| | |
|---|---|
| ***B65H 7/14*** | (2006.01) |
| ***B65H 5/06*** | (2006.01) |
| ***G03G 15/00*** | (2006.01) |
| ***B65H 7/20*** | (2006.01) |
| ***B65H 7/02*** | (2006.01) |
| ***B65H 7/18*** | (2006.01) |

(52) U.S. Cl.

CPC ..... *B65H 7/14* (2013.01); *B65H 5/062* (2013.01); *B65H 7/02* (2013.01); *B65H 7/18* (2013.01); *B65H 7/20* (2013.01); *G03G 15/657* (2013.01); *B65H 2513/10* (2013.01)

(58) Field of Classification Search

CPC ..... B65H 3/06; B65H 3/5215; B65H 5/062; B65H 5/34; B65H 7/02; B65H 7/04; B65H 7/14; B65H 7/18; B65H 2513/10; B65H 2513/11; B65H 2513/20; B65H 2513/23; B65H 2553/40; B65H 2553/41; B65H 2301/4452; B65H 2301/44522

See application file for complete search history.

(56) References Cited

U.S. PATENT DOCUMENTS 5,662,321 A * 9/1997 Borostyan ..... B65H 7/08 271/902
6,499,734 B1 * 12/2002 Tranquilla ..... B65H 5/06 271/272

(Continued)

FOREIGN PATENT DOCUMENTS

| | | | |
|---|---|---|---|
| JP | H07-196181 | A | 8/1995 |
| JP | 2006-008264 | A | 1/2006 |
| JP | 2017-154896 | A | 9/2017 |

*Primary Examiner* — Prasad V Gokhale

(74) *Attorney, Agent, or Firm* — Studebaker & Brackett PC

(57) ABSTRACT

A sheet feeding device includes a sheet feeding roller, a following roller, a rotational speed detection part, and a control part. The rotational speed detection part is configured to detect a rotational speed of the following roller. The control part is configured to accelerate a rotation of the sheet feeding roller and to adjust a sheet interval. The control part obtains a rotational rate of the following roller to the sheet feeding roller based on the rotational speed of the following roller, obtains an actual linear velocity of the sheet based on the rotational rate of the following roller and a theoretical linear velocity of the sheet after accelerating the rotation of the sheet feeding roller, and then adjusts the sheet interval based on the actual linear velocity of the sheet.

9 Claims, 4 Drawing Sheets

(56) References Cited

U.S. PATENT DOCUMENTS

| | | | | |
|---|---|---|---|---|
| 6,554,275 | B1 * | 4/2003 | Tranquilla | B65H 3/063<br>271/259 |
| 2001/0022422 | A1 * | 9/2001 | Tamura | B65H 7/18<br>271/265.01 |
| 2008/0258382 | A1 * | 10/2008 | deJong | H04N 1/00002<br>73/1.37 |

* cited by examiner

SHEET FEEDING DEVICE AND IMAGE FORMING APPARATUS

INCORPORATION BY REFERENCE

This application is based on and claims the benefit of priority from Japanese patent application No. 2020-105039 filed on Jun. 18, 2020, which is incorporated by reference in its entirety.

BACKGROUND

The present disclosure relates to a sheet feeding device and an image forming apparatus.

In an image forming apparatus, it is required to decreases a sheet interval as small as possible in order to secure productivity while suppressing a linear velocity of the sheet low in order to save power owing to decreasing a fixing temperature. For example, a technique is proposed, in which a sheet interval is measured by torque of a drive motor coupled to a retard roller, and a conveyance speed of the sheet is adjusted so as to have a predetermined sheet interval. In addition, another technique is proposed, in which a drive timing of a retard roller is adjusted so as to suppress an occurrence of abnormal noise by detecting a following state of the retard roller of a sheet feeding device and a multiple sheet feeding.

SUMMARY

In accordance with an aspect of the present disclosure, a sheet feeding device feeds a sheet from a sheet bundle set on a sheet feeding cassette. The sheet feeding device includes a sheet feeding roller, a following roller, a rotational speed detection part, and a control part. The sheet feeding roller conveys the sheet along a conveyance path. The following roller comes into pressure contact with the sheet feeding roller and follows the sheet feeding roller. The rotational speed detection part is configured to detect a rotational speed of the following roller. The control part is configured to accelerate a rotation of the sheet feeding roller and to adjust a sheet interval. The control part obtains a rotational rate of the following roller to the sheet feeding roller based on the rotational speed of the following roller, obtains an actual linear velocity of the sheet based on the rotational rate of the following roller and a theoretical linear velocity of the sheet after accelerating the rotation of the sheet feeding roller, and then adjusts the sheet interval based on the actual linear velocity of the sheet.

In accordance with an aspect of the present disclosure, an image forming apparatus includes the sheet feeding device and a fixing device fixing a toner on the sheet fed by the sheet feeding device.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
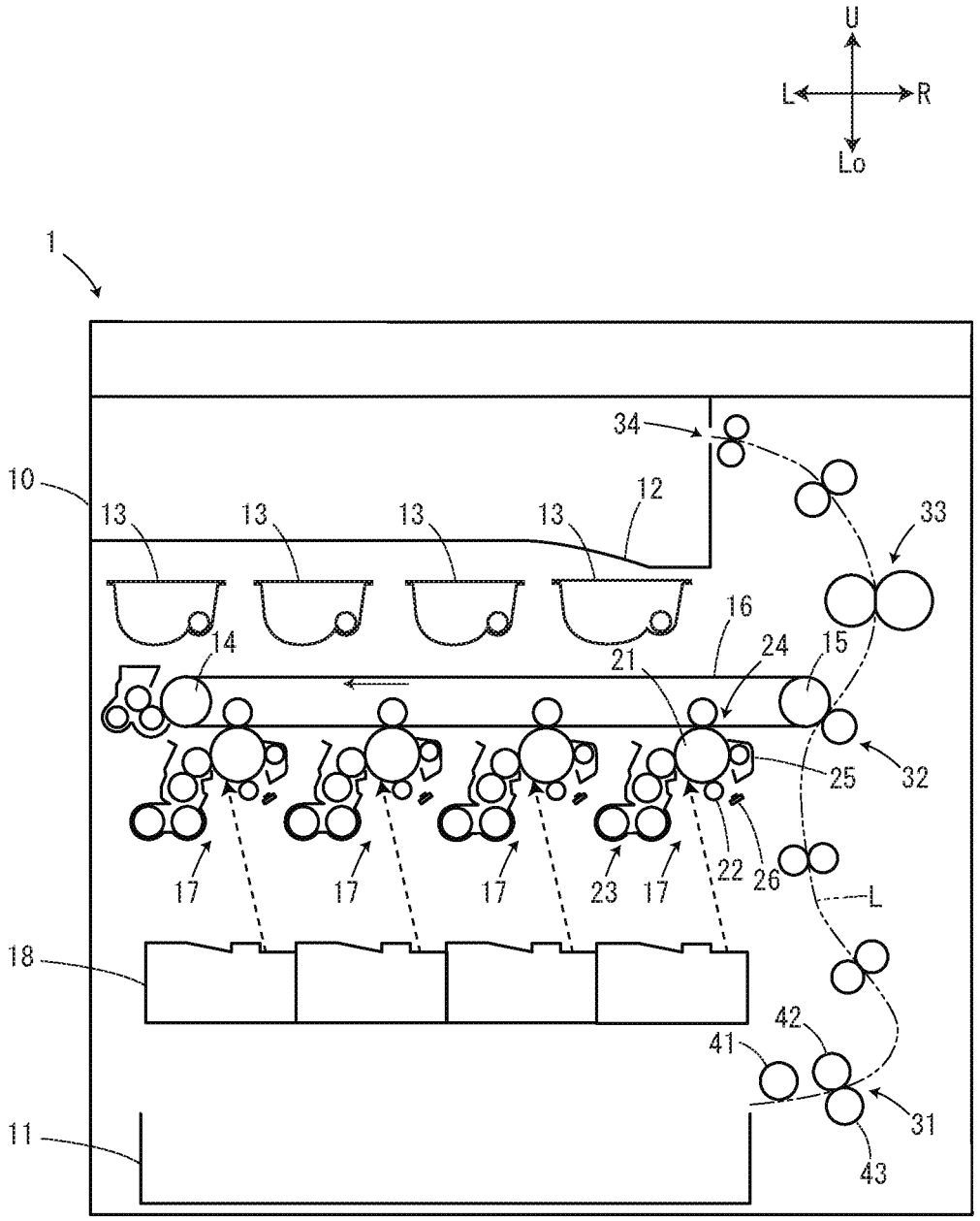
FIG. 1 is a view schematically showing a printer according to the present embodiment.

Hereinafter, with reference to the attached drawings, an image forming apparatus including a sheet feeding device will be described. In the following description, a printer will be described as an example of the image forming apparatus. FIG. 1 is a view schematically showing the printer according to a first embodiment. Arrows L, R, U and Lo marked in each figure show a left side, a right side, an upper side and a lower side of the printer, respectively.

As shown in FIG. 1, the printer 1 includes a box-shaped housing 10 in which various devices are stored. In the lower portion of the housing 10, a sheet feeding cassette 11 in which a sheet bundle is set is stored, and in the upper portion of the housing 10, a sheet discharge tray 12 on which image-formed sheets are stacked is provided. Below the sheet discharge tray 12, toner containers 13 storing toner are detachably set for each color (for example, magenta, cyan, yellow, and black) of the toner. Below the toner containers 13, an intermediate transferring belt 16 wound around a pair of right and left rollers 14, 15 is provided.

Along the lower side of the intermediate transferring belt 16, image forming sections 17 are disposed in line along the right-and-left direction for each color of the toner. Each image forming section 17 includes a rotatable photosensitive drum 21 rotating with coming into contact with the intermediate transferring belt 16. Around the photosensitive drum 21, a charger 22, a development device 23, a first transferring part 24, a cleaning device 25 and an eraser 26 are disposed in order of a primary transferring process. To the cleaning device 25, a waste toner box (not shown) is connected. The toner is supplied to each development device 23 from the corresponding toner container 13 through a supply path (not shown), and waste toner is discharged to the waste toner box from each cleaning device 25 through a discharge path (not shown).

Below the image forming sections 17, an exposure device 18 constituted of a laser scanning unit (LSU) is provided. A sheet conveyance path L is formed in the right side portion of the inside of the housing 10 by a plurality of rollers from the sheet feeding cassette 11 to the sheet discharge tray 12. A sheet feeding device 31 is provided at the upstream end (the lower end) of the conveyance path L, and a secondary transferring part 32 is provided on the right end side of the intermediate transferring belt 16 at the downstream of the sheet feeding device 31 on the conveyance path L. A fixing device 33 is provided at the downstream of the secondary transferring part 32 on the conveyance path L, and a sheet discharge port 34 is provided at the downstream end (the upper end) of the conveyance path L.

When the printer 1 forms an image, after the surface of the photosensitive drum 21 is charged by the charger 22, an electrostatic latent image is formed on the surface of the photosensitive drum 21 by laser beam emitted from the exposure device 18. Next, the toner is attracted to the electrostatic latent image on the surface of the photosensitive drum 21 from the development device 23 to form a toner image, and the toner image is primarily transferred from the surface of the photosensitive drum 21 to the surface of the intermediate transferring belt 16. In each image forming section 17, the toner image of each color is primarily transferred to the intermediate transferring belt 16 to form a full-color toner image on the surface of the intermediate transferring belt 16. The waste toner and the electric charge remaining on the photosensitive drum 21 are removed by the cleaning device 25 and the eraser 26.

On the other hand, the sheet is fed from the sheet feeding cassette 11 or a manual bypass tray (not shown) by the sheet feeding device 31, and the fed sheet is conveyed toward the secondary transferring part 32 in timing with the image forming operation described above. At the secondary transferring part 32, the full-color toner image is secondarily transferred from the surface of the intermediate transferring belt 16 to the surface of the sheet, and the sheet after the secondary transferring is conveyed to the fixing device 33 disposed at the downstream of the secondary transferring part 32. In the fixing device 33, the toner image is fixed to the sheet, and the sheet on which the toner image is fixed is discharged through the sheet discharge port 34 on the sheet discharge tray 12. In the above manner, the toner image transferred on the sheet passes through the fixing device 33 to form the image on the surface of the sheet.

In the sheet feeding device 31 of the printer 1, a conveyance nip area is formed between a sheet feeding roller 42 and a retard roller 43 (an example of a following roller), and the sheet is fed from the sheet feeding cassette 11 to the conveyance nip area by a pickup roller 41. To the retard roller 43, a torque limiter 46 (see FIG. 2) is connected. When the earlier sheet and the later sheet are conveyed together in the overlapped condition, the torque limiter 46 stops the retard roller 43 to separate the later sheet from the earlier sheet. In such a way, the sheet is conveyed from the sheet feeding cassette 11 along the conveyance path L one by one by the sheet feeding device 31.

At this time, the sheet feeding device 31 adjusts a sheet interval between the tail end of the earlier sheet and the leading end of the later sheet. In a case where the sheet interval is larger than a target value, a rotation of the sheet feeding roller 42 is accelerated so as to bring the leading end of the later sheet close to the tail end of the earlier sheet. However, if the rotation of the sheet feeding roller 42 is accelerated to have a predetermined rotational speed, the sheet is not always conveyed at a theoretical linear velocity based on a rotational speed of the sheet feeding roller 42 (hereinafter, called a theoretical linear velocity). Because an actual liner velocity of the sheet (hereinafter, called an actual linear velocity) is slower than the theoretical linear velocity, it is difficult to adjust the sheet interval to the target interval with high accuracy.

The actual linear velocity of the sheet is varied depending on a rotational rate (a following rate) of the retard roller 43 to the sheet feeding roller 42. In detail, the rotational rate of the retard roller 43 is varied depending on friction between the retard roller 43 and the sheet and abrasion of the retard roller 43, and a difficulty in rotation of the retard roller 43 applies a conveyance load on the sheet. Especially, because the retard roller 43 is not rotated when the later sheet is separated from the earlier sheet, a conveyance load of the retard roller 43 applied on the sheet becomes large. Then, the sheet feeding device 31 of the present embodiment is configured to obtain the actual linear velocity of the sheet from the rotational rate of the retard roller 43 and to adjust the sheet interval with high accuracy.

Figure 2:
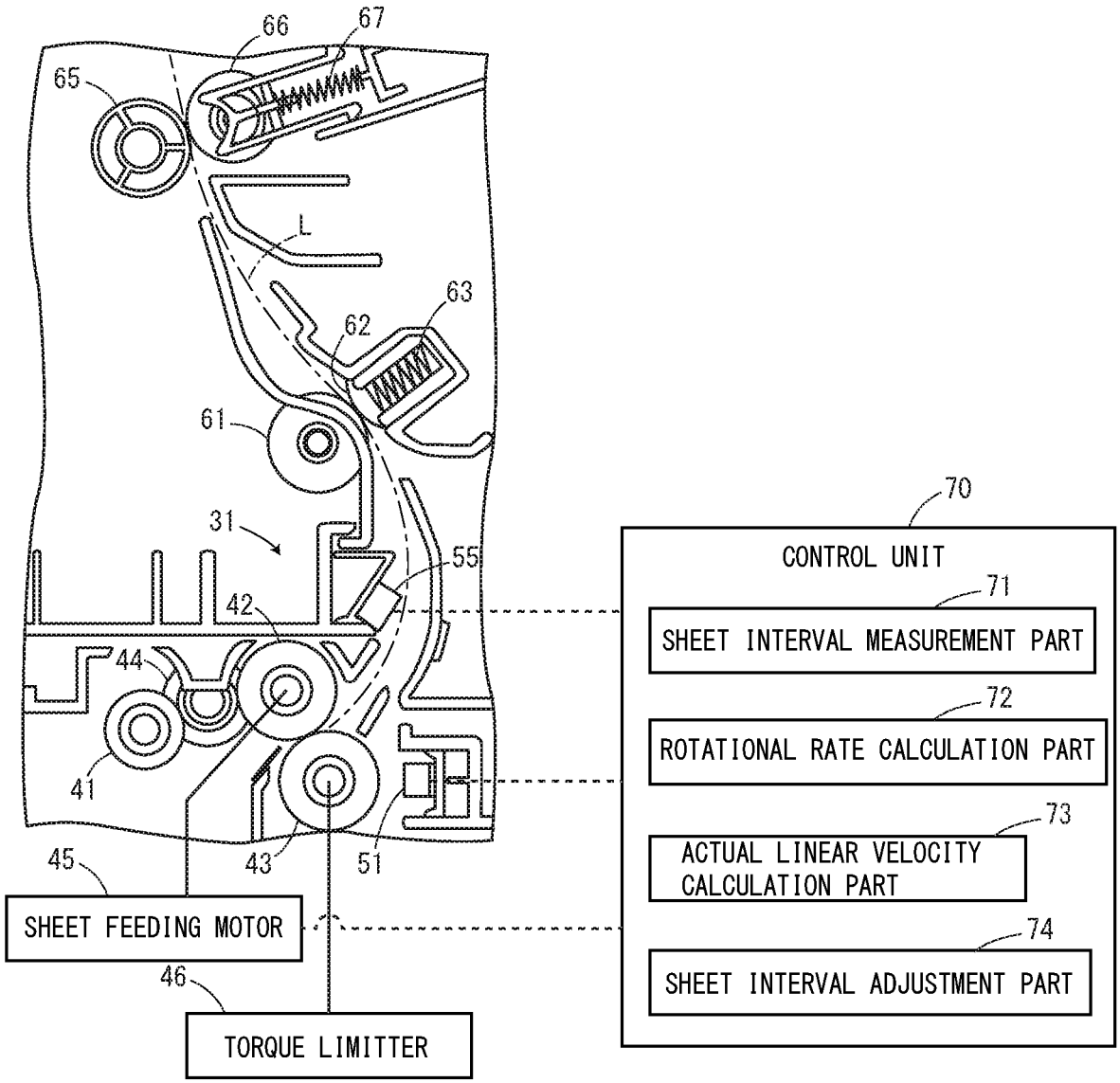
FIG. 2 is a view schematically showing a sheet feeding device according to the present embodiment.
Figure 3:
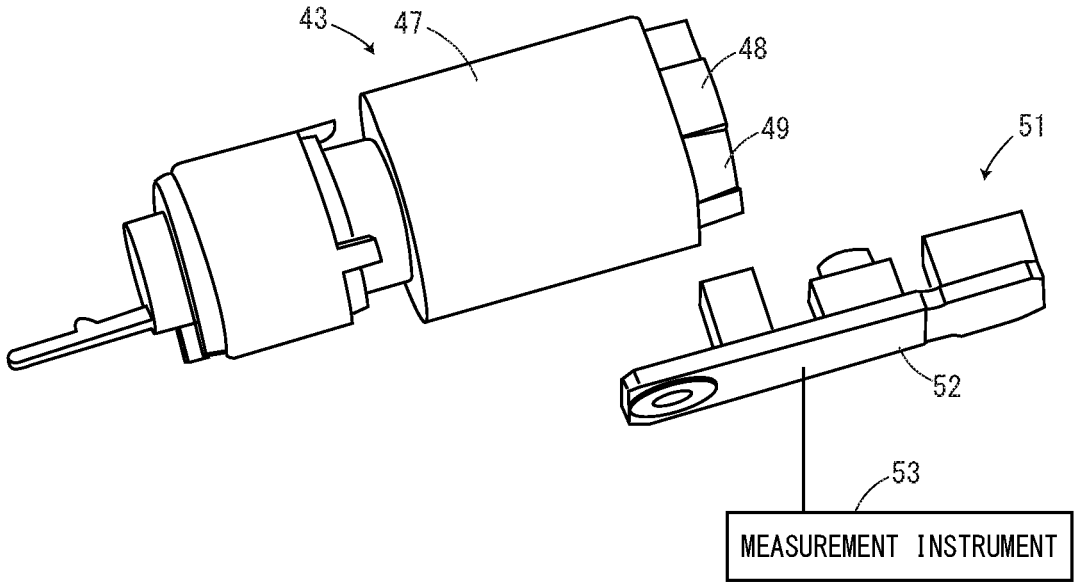
FIG. 3 is a perspective view showing a retard roller and a rotational speed sensor according to the present embodiment.

Hereinafter, with reference to FIG. 2, the sheet feeding device 31 will be described. FIG. 2 is a view schematically showing the sheet feeding device 31 in the present embodiment. FIG. 3 is a perspective view showing the retard roller and a rotational speed sensor in the present embodiment.

As shown in FIG. 2, the sheet feeding device 31 includes the pickup roller 41 which feeds the sheet from the sheet feeding cassette 11 (see FIG. 1), the sheet feeding roller 42 which conveys the fed sheet along the conveyance path L, and the retard roller 43 which comes into pressure contact with the sheet feeding roller 42 and follows the sheet feeding roller 42. To the pickup roller 41, the sheet feeding roller 42 is connected via a transmission gear 44, and a sheet feeding motor 45 is connected to the sheet feeding roller 42 via a gear train (not shown). When the sheet feeding motor 45 is driven to rotate the sheet feeding roller 42 and the pickup roller 41, the sheet is conveyed from the pickup roller 41 to the sheet feeding roller 42.

To the retard roller 43, the torque limiter 46 is coupled, and the retard roller 43 is stopped by the torque limiter 46 until a torque larger than a predetermined torque is applied to the retard roller 43. If the later sheet is overlapped with the earlier sheet, because the retard roller 43 is stopped, the later sheet is separated from the earlier sheet and then the earlier sheet is conveyed toward the conveyance path L by the sheet feeding roller 42. Near the retard roller 43, a rotational speed sensor (a rotational speed detection part) 51 which detects a rotational speed of the retard roller 43 is provided. A configuration for detecting the rotational speed of the retard roller 43 by the rotational speed sensor 51 will be described later.

At the downstream of the sheet feeding roller 42 and the retard roller 43, a sheet sensor (a sheet detection part) 55 which detects a passing of the leading end and the tail end of the sheet is provided. For example, the sheet sensor 55 is constituted of a reflection type photosensor, and outputs an ON signal and an OFF signal in response to light reflected on the sheet. At a timing when the output of the sheet sensor 55 is switched from the OFF signal to the ON signal, the passing of the leading end of the sheet is detected. On the other hand, at a timing when the output of the sheet sensor 55 is switched from the ON signal to the OFF signal, the passing of the tail end of the sheet is detected. The sheet sensor 55 may be constituted of a transmission type photosensor.

At the downstream of the sheet sensor 55, a pair of conveyance rollers 61, 62 which convey the sheet along the conveyance path L is provided. One conveyance roller 61 is connected to a conveyance motor (not shown) via a gear train (not shown). The other conveyance roller 62 is brought into pressure contact with the one conveyance roller 61 by a spring 63, and follows the one conveyance roller 61. The gear train of the conveyance roller 61 and the conveyance motor is independent of the gear train of the sheet feeding roller 42 and the sheet feeding motor 45, so that it becomes possible to control the conveyance roller 61 and the sheet feeding roller 42 individually.

At the downstream of the pair of conveyance rollers 61, 62, a pair of resist rollers 65, 66 which feed the sheet toward the secondary transferring part 32 (see FIG. 1) is provided. One resist roller 65 is connected to a resist motor (not shown) via a gear train (not shown). The other resist roller 66 is brought into pressure contact with the one resist roller 65 by a spring 67, and follows the one resist roller 65. At a timing with the image forming operation, the sheet is conveyed from the resist rollers 65, 66 to the secondary transferring part 32, and the image is transferred on the surface of the sheet by the secondary transferring part 32.

The sheet feeding device 31 includes a control unit 70 which controls each part of the device. The control unit 70 accelerates the rotation of the sheet feeding roller 42 to adjust the sheet interval. When the tail end of the earlier sheet passes the sheet sensor 55 and the leading end of the later sheet passes the sheet sensor 55, the control unit 70 accelerates the rotation of the sheet feeding roller 42 for a predetermined period to adjust the sheet interval between the tail end of the earlier sheet and the leading end of the later sheet. As the rotational speed before and after accelerating the rotation of the sheet feeding roller 42, a value previously obtained experimentally, empirically or theoretically is used. Further, the control unit 70 includes a sheet interval measurement part 71, a rotational rate calculation part 72, an actual linear velocity calculation part 73 and a sheet interval adjustment part 74.

The sheet interval measurement part 71 measures the sheet interval from the detection result of the tail end of the earlier sheet and the leading end of the later sheet by the sheet sensor 55. To the sheet interval measurement part 71, the ON signal and the OFF signal are input from the sheet sensor 55 as a detection signal of the leading end and the tail end of the sheet, and the tail end of the earlier sheet and the leading end of the later sheet are detected by switching between the ON signal and the OFF signal. Then, the sheet interval is obtained by a time interval between a detection time of the tail end of the earlier sheet and a detection time of the leading end of the later sheet and a set linear velocity of the sheet. As the set linear velocity of the sheet, a value previously obtained experimentally, empirically or theoretically is used.

The rotational rate calculation part 72 calculates the rotational rate of the retard roller 43 to the sheet feeding roller 42 based on the rotational speed of the retard roller 43. To the rotational rate calculation part 72, the rotational speed of the retard roller 43 is input from the rotational speed sensor 51 at a time of measuring the sheet interval, and the rotational rate of the retard roller 43 to the sheet feeding roller 42 is calculated from the rotational speed of the retard roller 43 and the rotational speed of the sheet feeding roller 42 before accelerating the rotation of the sheet feeding roller 42. The rotational rate α of the retard roller 43 is expressed by the following equation (1), where the rotational speed of the sheet feeding roller 42 before accelerating the rotation of the sheet feeding roller 42 is set to N0 and the rotational speed of the retard roller 43 is set to N1, $$\alpha=(N1/N0)\times 100. \quad (1)$$

The actual linear velocity calculation part 73 calculates the actual linear velocity of the sheet based on the rotational rate of the retard roller 43, and the theoretical linear velocity of the sheet after accelerating the rotation of the sheet feeding roller 42. The theoretical linear velocity V of the sheet is expressed by the following equation (2), where the rotational speed of the sheet feeding roller 42 after accelerating the rotation of the sheet feeding roller 42 is set to N2 and a diameter of the sheet feeding roller 42 is set to R. Further, the actual linear velocity Vr of the sheet is expressed by the following equation (3), where the theoretical linear velocity of the sheet is set to V and the rotational rate of the retard roller 43 is set to a. When the rotational rate α of the retard roller 43 is equal to or less than 70(%), a value obtained by multiplying the theoretical linear velocity V by a fixed value (for example, 0.85) is used as the actual linear velocity Vr.

$$V=N2\times R, \text{ and} \quad (2)$$

$$Vr=V\times(100-(100-\alpha)/2)/100. \quad (3)$$

For example, when the retard roller 43 follows the sheet feeding roller 42 completely (α=100(%)), the actual linear velocity Vr of the sheet is equal to the theoretical linear velocity V of the sheet (Vr=V). When the retard roller 43 follows the sheet feeding roller 42 only by 70% (α=70(%)), the actual linear velocity Vr of the sheet becomes 0.85 times the theoretical linear velocity V of the sheet (Vr=0.85 V). Because the rotational rate α of the retard roller 43 and the actual linear velocity Vr of the sheet are different for a type of the sheet feeding device 31, the above calculation way is not limited to the above way, and a calculation way depending on the type may be appropriately applied.

The sheet interval adjustment part 74 sets a rotation acceleration period of the sheet feeding roller 42 based on the actual linear velocity of the sheet and measurement values of the sheet interval such that the sheet interval is close to the target value. To the sheet interval adjustment part 74, the actual linear velocity of the sheet after accelerating the rotation of the sheet feeding roller 42 is input from the actual linear velocity calculation part 73, and the measurement value of the sheet interval is input from the sheet interval measurement part 71. The rotation acceleration period t of the sheet feeding roller 42 is expressed by the following equation (4), wherein the actual sheet velocity of the sheet is set to Vr, the measurement value of the sheet interval is set to X and the target value of the sheet interval is set to Xa, $$t=(X-Xa)/Vr. \quad (4)$$

Thereby, the rotation of the sheet feeding roller 42 is accelerated for a period in which the sheet interval becomes equal to the target value to adjust the sheet interval.

Each part of the control unit 70 may be achieved by software using a processor or by a logic circuit (a hardware) formed in an integrated circuit or the like. When the processor is used, various processes are executed by reading and executing a program stored in a memory by the processor. For example, a CPU (a Central Processing Unit) is used as the processor. The memory is constituted from one or a plurality of storage media, such as a ROM (a Read Only Memory) and a RAM (a Random Access Memory) depending on the application.

Next, a configuration for detecting the rotational speed of the retard roller 43 by the rotational speed sensor 51 will be briefly described. As shown in FIG. 3, the rotational speed sensor 51 is a so-called reflection type photosensor, and is formed so as to emit detection light toward the outer circumferential face of the retard roller 43 and to detect the rotational speed of the retard roller 43 based on the light reflected on the outer circumferential face of the retard roller 43. One end portion of the outer circumferential face of the retard roller 43 is recessed in a stepped shape. A sheet conveyance face 47 is formed on the upper step of the retard roller 43, and first and second reflection faces 48 and 49 for reflecting the detection light from the rotational speed sensor 51 are alternately formed in the circumferential direction on the lower step of the retard roller 43.

The first reflection face 48 is formed so as to reflect the detection light toward the rotational speed sensor 51, and the second reflection face 49 is inclined so as to reflect the detection light in a direction separated from the rotational speed sensor 51. The rotational speed sensor 51 includes a measurement instrument 53, a pulse signal which is an ON/OFF signal is output from a sensor part 52 to the measurement instrument 53, and the rotational speed of the retard roller 43 is obtained from the pulse signal by the measurement instrument 53. By such a simple configuration, it becomes possible to detect the rotational speed of the retard roller 43. In addition, because the first and second reflection faces 48, 49 are formed on the outer circumferential face of the retard roller 43 at a smaller diameter portion than the sheet conveyance face 47, an occurrence of a sheet jamming owing to interference between the first and second reflection faces 48 and 49 and the sheet is suppressed.

In the present embodiment, the rotational speed sensor 51 detects the rotational speed of the retard roller 43 by a difference in inclination of the first and second reflection faces 48 and 49, but the rotational speed sensor 51 may have a configuration in which the rotational speed of the retard roller 43 is detectable. For example, the rotational speed sensor 51 may detect the rotational speed of the retard roller by a difference in reflection rate of the first and second reflection faces 48 and 49. Further, the rotational speed sensor 51 may detect the rotational speed of the retard roller 43 by one reflection face. Further, a pulse plate may be attached to a rotational shaft of the retard roller 43, and the rotational speed sensor 51 may be a transmission type photosensor.

Figure 4A:
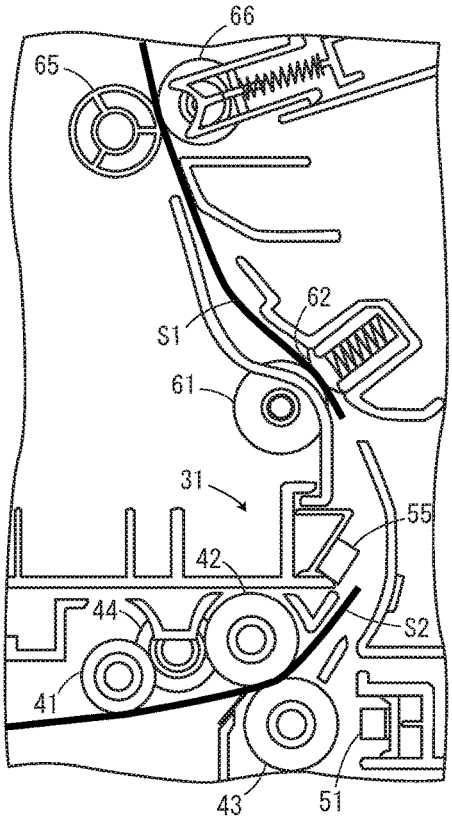
FIG. 4A is a view showing a sheet conveyance state before accelerating a rotation of a sheet feeding roller, in the present embodiment.
Figure 4B:
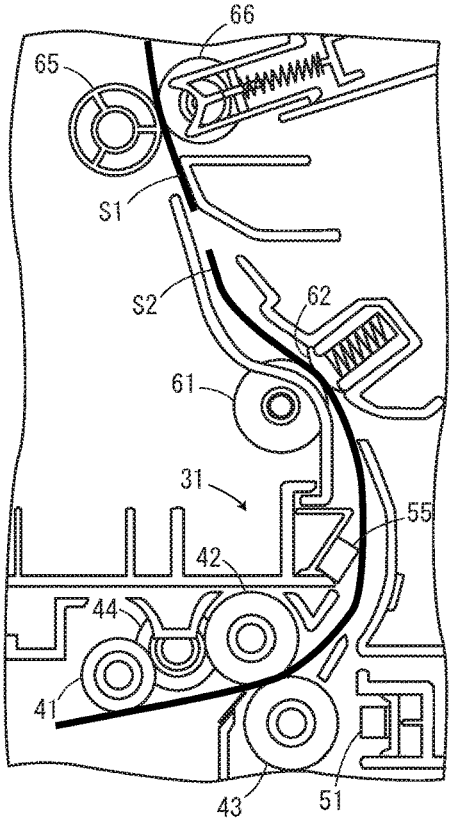
FIG. 4B is a view showing a sheet conveyance state after accelerating the rotation of the sheet feeding roller, in the present embodiment.

With reference to FIG. 4A and FIG. 4B, an operation for adjusting the sheet interval will be described. FIG. 4A is a view showing a conveyance state of the sheet before accelerating the rotation of the sheet feeding roller, in the present embodiment. FIG. 4B is a view showing a conveyance state of the sheet after accelerating the rotation of the sheet feeding roller, in the present embodiment. Here, reference numbers shown in FIG. 2 are used appropriately.

As shown in FIG. 4A, when the earlier sheet S1 is fed from the pair of conveyance rollers 61 and 62 to the resist rollers 65 and 66, the later sheet S2 is fed from the pickup roller 41 to the sheet feeding roller 42 and the retard roller 43. At this time, the sheet feeding roller 42 conveys the sheet at the rotational speed before accelerating the rotation. When the tail end of the earlier sheet S1 passes the sheet sensor 55 and the leading end of the later sheet S2 passes the sheet sensor 55, the sheet interval measurement part 71 measures the sheet interval based on the detection times of the tail end of the earlier sheet S1 and the leading end of the later sheet S2 by the sheet sensor 55.

At this time, the rotational speed sensor 51 detects the rotational speed of the retard roller 43, and the rotational rate calculation part 72 calculates the rotational rate of the retard roller 43 from the rotational speed of the sheet feeding roller 42 and the rotational speed of the retard roller 43. Next, the actual linear velocity calculation part 73 calculates the actual linear velocity of the sheet from the obtained rotational rate of the retard roller 43 and the theoretical linear velocity of the sheet after accelerating the rotation of the sheet feeding roller 42, and the sheet interval adjustment part 74 sets the rotation acceleration period of the sheet feeding roller 42 from the actual linear velocity of the sheet, the measurement value of the sheet interval and the target value of the sheet interval. Thus, a period in which the sheet interval becomes equal to the target value when the rotation of the sheet feeding roller 42 is accelerated can be obtained.

Then, as shown in FIG. 4B, the rotation of the sheet feeding roller 42 is accelerated for the rotation acceleration period obtained by the sheet interval adjustment part 74, and the later sheet S2 is conveyed to the earlier sheet S1 at the actual linear velocity in the rotation acceleration period. Thus, the sheet interval between the earlier sheet S1 and the later sheet S2 is close to the target value, and the earlier sheet S1 and the later sheet S2 are conveyed toward the fixing device 33 (see FIG. 1) with keeping the sheet interval constant. Therefore, it becomes possible to secure productivity by narrowing the sheet interval between the earlier sheet S1 and the later sheet S2. In addition, it becomes possible to decrease the linear velocity of the sheet in the fixing device 33 by the narrowed distance and thus to decrease the fixing temperature, thereby to save power.

As described above, according to the present embodiment, when the rotation of the sheet feeding roller 42 is accelerated to adjust the sheet interval, the actual linear velocity of the sheet in consideration of the conveyance load of the retard roller 43 to the sheet is obtained by using the rotational rate of the retard roller 43 following the sheet feeding roller 42. Thereby, even in a case where the actual linear velocity is lower than the theoretical linear velocity of the sheet owing to the conveyance load of the retard roller 43, it becomes possible to adjust the sheet interval based on the actual linear velocity of the sheet with high accuracy. Further, by narrowing the sheet interval in order to secure productivity, it becomes possible to decrease the linear velocity of the sheet in the fixing device 33 and thus to decrease the fixing temperature, thereby to save power.

In the present embodiment, the retard roller is an example of a following roller following the sheet feeding roller, but the following roller is not limited to the retard roller. The following roller may be rotated by following the sheet feeding roller, and may not have a function for separating the later sheet from the earlier sheet. Then, the following roller may not be coupled to the torque limiter.

Further, although the printer is shown as an example of the image forming apparatus in each embodiment, the image forming apparatus may be a multifunctional peripheral having a printing function, a copying function, a facsimile function, etc., in addition to a copying machine and a facsimile machine.

In each embodiment, the sheet may have a sheet like shape on which an image is to be formed, for example, a plain paper, a coated paper, a tracing paper, or an OHP (Over Head Projector) sheet.

Although the present embodiment has been described, as another embodiment, the above-described embodiment and the modified example may be wholly or partially combined.

Further, the technique of the present disclosure is not limited to the above-described embodiment, and various changes, substitutions, and modifications may be made without departing from the spirit of the technical idea. Furthermore, if technological advances or other derived technologies can realize the technical ideas in other ways, they may be carried out using such methods. Accordingly, the claims cover all embodiments that may be contained within the scope of the technical concept.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. A sheet feeding device which feeds a sheet from a sheet bundle set on a sheet feeding cassette, the sheet feeding device comprising:

a sheet feeding roller conveying the sheet along a conveyance path;

a following roller coming into pressure contact with the sheet feeding roller and following the sheet feeding roller;

a rotational speed detection part configured to detect a rotational speed of the following roller; and a control part configured to accelerate a rotation of the sheet feeding roller and to adjust a sheet interval, wherein the control part obtains a rotational rate of the following roller to the sheet feeding roller based on the rotational speed of the following roller, obtains an actual linear velocity of the sheet based on the rotational rate of the following roller and a theoretical linear velocity of the sheet after accelerating the rotation of the sheet feeding roller, and then adjusts the sheet interval based on the actual linear velocity of the sheet.

2. The sheet feeding device according to claim 1, wherein the rotational rate of the following roller is expressed by an equation (1), where the rotational rate of the following roller is set to α, the rotational speed of the sheet feeding roller before accelerating the rotation of the sheet feeding roller is set to N0, and the rotational speed of the following roller is set to N1, the theoretical linear velocity of the sheet after accelerating the rotation of the sheet feeding roller is expressed by an equation (2), where the theoretical linear velocity of the sheet after accelerating the rotation of the sheet feeding roller is set to V, the rotational speed of the sheet feeding roller after accelerating the rotation of the sheet feeding roller is set to N2, and a diameter of the sheet feeding roller is set to R, and the actual linear velocity of the sheet is expressed by an equation (3), where the actual liner velocity of the sheet is set to Vr, $$\alpha=(N1/N0)\times 100. \quad (1)$$

$$V=N2\times R, \text{ and} \quad (2)$$

$$Vr=V\times(100-(100-\alpha)/2)/100. \quad (3)$$

3. The sheet feeding device according to claim 1, comprising a sheet detection part configured to detect a passing of a leading end and a tail end of the sheet, wherein, the control part measures the sheet interval based on a detection result of the tail end of the earlier sheet and the leading end of the later sheet, and adjusts the sheet interval so as to be close to a target value based on a measurement value of the sheet interval and the actual linear velocity of the sheet.

4. The sheet feeding device according to claim 3, wherein the control part sets an acceleration period of the sheet feeding roller based on the measurement value of the sheet interval, the target value of the sheet interval and the actual linear velocity of the sheet, and adjusts the sheet interval so as to be close to the target value.

5. The sheet feeding device according to claim 1, wherein the rotational speed detection part is configured to emit detection light toward an outer circumferential face of the following roller and to detect the rotational speed of the following roller based on the detection light reflected on the outer circumferential face of the following roller, and a first reflection face reflecting the detection light toward the rotational speed detection part and a second reflection face reflecting the detection light in a direction separated from the rotational speed detection part are alternately formed in a circumferential direction on the outer circumferential face of the following roller.

6. The sheet feeding device according to claim 5, wherein the first reflection face and the second reflection face are formed on the outer circumferential face of the following roller at a smaller diameter portion than a sheet conveyance face.

7. The sheet feeding device according to claim 1, wherein the following roller is a retard roller which separates the later sheet overlapped on the earlier sheet from the earlier sheet.

8. The sheet feeding device according to claim 7, wherein the retard roller is connected to a torque limiter.

9. An image forming apparatus comprising:

the sheet feeding device according to claim 1; and a fixing device fixing a toner on the sheet fed by the sheet feeding device.

* * * * *